US011756473B2

(12) United States Patent
Jun

(10) Patent No.: US 11,756,473 B2
(45) Date of Patent: Sep. 12, 2023

(54) DIGITAL GAMMA CIRCUIT AND SOURCE DRIVER INCLUDING THE SAME

(71) Applicant: LX Semicon Co., Ltd., Daejeon (KR)

(72) Inventor: Young Jun Jun, Daejeon (KR)

(73) Assignee: LX SEMICON CO., LTD., Daejeon (KR)

( * ) Notice: Subject to any disclaimer, the term of this patent is extended or adjusted under 35 U.S.C. 154(b) by 0 days.

(21) Appl. No.: 17/555,301

(22) Filed: Dec. 17, 2021

(65) Prior Publication Data

US 2022/0198986 A1 Jun. 23, 2022

(30) Foreign Application Priority Data

Dec. 21, 2020 (KR) ..... 10-2020-0179291

(51) Int. Cl.
*G09G 3/20* (2006.01)

(52) U.S. Cl.
CPC ... *G09G 3/2007* (2013.01); *G09G 2320/0276* (2013.01); *G09G 2320/041* (2013.01)

(58) Field of Classification Search
None
See application file for complete search history.

(56) References Cited

U.S. PATENT DOCUMENTS 6,862,012 B1 * 3/2005 Funakoshi ..... G09G 3/2092 345/88
11,315,525 B1 * 4/2022 Hong ..... G09G 5/10
2001/0015774 A1 * 8/2001 Endo ..... H04N 9/73 348/708
2012/0013635 A1 * 1/2012 Beeman ..... G09G 5/02 345/590

FOREIGN PATENT DOCUMENTS

JP 2016-031461 A 3/2016
KR 2004-0077353 A 9/2004
KR 2014-0060007 A 5/2014
KR 2017-0081047 A 7/2017

* cited by examiner

*Primary Examiner* — Matthew Yeung
(74) *Attorney, Agent, or Firm* — POLSINELLI PC

(57) ABSTRACT

Disclosed are a digital gamma circuit capable of reducing a chip area and adjusting white color coordinates, and a source driver including the same. The digital gamma circuit may include a digital gamma algorithm for setting a gamma curve for each R, G, or B. Through the digital gamma algorithm, values of X-axis points of the gamma curve may be set, values of Y-axis points of the gamma curve corresponding to the values of the X-axis points may be set, and a value of at least one Y-axis point indicative of white among the values of the Y-axis points may be adjusted by adding an offset value thereto.

18 Claims, 3 Drawing Sheets

DIGITAL GAMMA CIRCUIT AND SOURCE DRIVER INCLUDING THE SAME

BACKGROUND

1. Technical Field

The present disclosure relates to a display apparatus, and more particularly, to a digital gamma circuit having a function for adjusting white color coordinates and a source driver including the same.

2. Related Art

In general, a display apparatus may include a display panel, a display driving apparatus, a timing controller, etc.

The display driving apparatus may include a source driver, and may include a plurality of source drivers by taking the size and resolution of a display panel into consideration. The source driver may convert image data into a source signal by using gamma voltages, and may provide the source signal to the display panel.

The source driver may include a digital gamma circuit for generating data for selecting a voltage corresponding to a gray level among grayscale voltages. In this case, the gray level means a degree of brightness of a screen.

A human eye is sensitive to a dark gray level and is insensitive to a bright gray level. The digital gamma circuit may support selecting a gamma voltage so that brightness for each gray level is seen by a human eye at uniform intervals.

It is the most preferred that the digital gamma circuit is configured to select a gamma voltage corresponding to each gray level, but the digital gamma circuit has a difficulty in implementing the aforementioned construction due to the limit of a chip size.

A digital gamma circuit according to a conventional technology does not have a function for adjusting white color coordinates.

SUMMARY

Various embodiments are directed to providing a digital gamma circuit capable of reducing a chip area and adjusting white color coordinates, and a source driver including the same.

In an embodiment, a digital gamma circuit may include a digital gamma algorithm for setting a gamma curve for each R, G, or B. Through the digital gamma algorithm, values of X-axis points of the gamma curve may be set, values of Y-axis points of the gamma curve corresponding to the values of the X-axis points may be set, and a value of at least one Y-axis point indicative of white among the values of the Y-axis points may be adjusted by adding an offset value thereto.

In an embodiment, the values of X-axis points of the gamma curve may be set at intervals of a square of 2.

In an embodiment, a source driver may include a digital gamma circuit configured to set a gamma curve for each R, G, or B and convert an inputted gray signal into data indicative of a luminance value by using the gamma curve, a gamma voltage generator configured to generate and provide gamma voltages, and a gamma decoder configured to receive the gamma voltages and the data and select and output a gamma voltage corresponding to the data. The digital gamma circuit may set values of X-axis points of the gamma curve, may set values of Y-axis points of the gamma curve corresponding to the values of the X-axis points, and may adjust a value of at least one Y-axis point indicative of white among the values of the Y-axis points by adding an offset value thereto.

The digital gamma circuit of the present disclosure can adjust white color coordinates by adding an offset value to a value of at least one Y-axis point indicative of white among values of Y-axis points of a gamma curve.

Furthermore, the digital gamma circuit of the present disclosure can reduce power and a chip area of logic by setting values of X-axis points of a gamma curve at intervals of a square of 2 through a shift operation without using a divider in the digital design.

As power and a chip area of logic of the digital gamma circuit are reduced as described above, the source driver including the digital gamma circuit according to the present disclosure can also reduce power consumption and can have a reduced chip area.

DETAILED DESCRIPTION

The present disclosure discloses a digital gamma circuit capable of reducing a chip area and adjusting white color coordinates, and a source driver including the same.

In embodiments, a gray signal GRAY may be defined as a signal indicative of a degree of brightness of a screen. For example, the gray signal may indicate brightness of a screen within a grayscale having 0 to 255 levels, that is, a gray level, and may be inputted as 12-bit data.

In embodiments, a gamma curve may be defined as indicating a correlation between a gray signal and luminance of an image displayed on a display panel.

In embodiments, an X-axis point of the gamma curve may indicate the gray signal, a Y-axis point of the gamma curve may indicate luminance, and a slope may indicate a gamma value.

In embodiments, a gamma value may indicate a ratio of a change in luminance to a change in brightness of a screen.

In embodiments, a command signal CMD may be defined as a signal provided from the outside in order to adjust white color coordinates with respect to various color standards.

In describing embodiments, a detailed description of a publicly-known technology in the technical field will be omitted in order to avoid making obscure the subject matter of the present disclosure.

Figure 1:
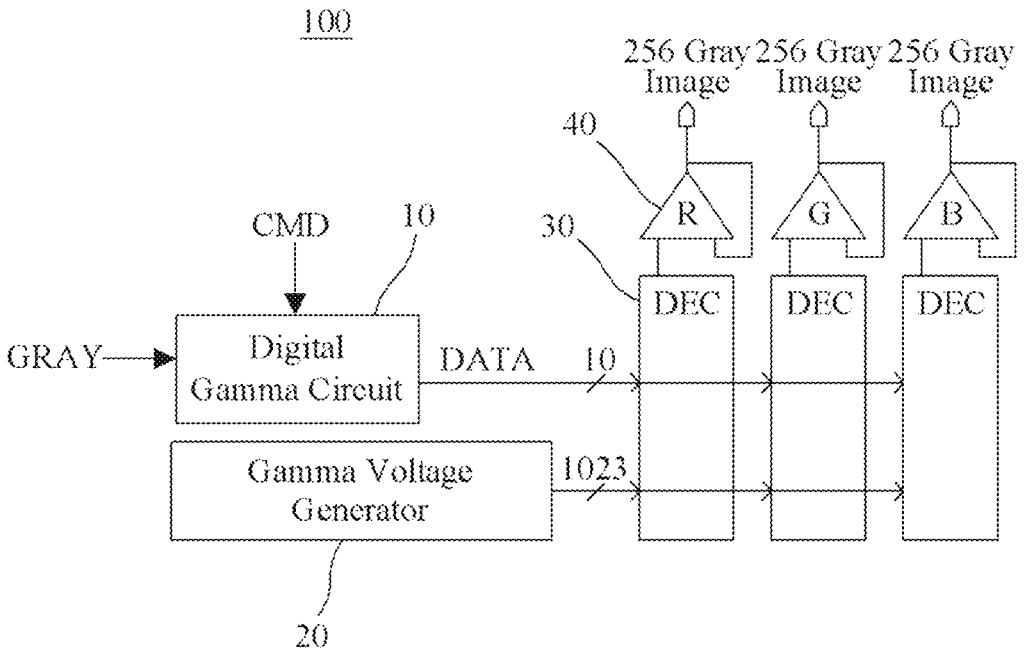
FIG. 1 is a block diagram illustrating a source driver according to an embodiment of the present disclosure.

FIG. 1 is a block diagram of a source driver 100 including a digital gamma circuit 10 according to an embodiment.

Referring to FIG. 1, the source driver 100 may include the digital gamma circuit 10, a gamma voltage generator 20, a gamma decoder (DEC) 30 and an output buffer 40.

The digital gamma circuit 10 may set a gamma curve for each red (R), green (G), or blue (B).

The digital gamma circuit 10 may set values of X-axis points of a gamma curve and values of Y-axis points of the gamma curve corresponding to the values of the X-axis points.

In this case, the digital gamma circuit 10 may set the values of the X-axis points at intervals of a square of 2. To limit the intervals of values of the X-axis points to the square of 2 is for replacing a divider with a shift operation without using the divider upon linear interpolation in the digital design. Accordingly, there is an advantage in that power and a chip area of logic of the digital gamma circuit 10 are reduced.

Furthermore, the digital gamma circuit 10 may adjust white color coordinates by adding an offset value for each R, G, or B to a value of at least one Y-axis point indicative of white, among the values of the Y-axis points. For example, the digital gamma circuit 10 may adjust white color coordinates by adding a different offset value to values of two or more Y-axis points indicative of white. For another example, when it is set which of Y-axis points is a white point, the digital gamma circuit 10 may adjust white color coordinates by adding the same offset value to values of the Y-axis points after the white point.

Offset values may be set with respect to each of various color standards. Examples of the color standards may include Adobe RGB, StandardRGB (sRGB), Digital Cinema Initiatives (DCI)-P3, etc. X, Y coordinates for R, G, B, W may be different for each color standard, and other offset values may be applied to the color standards.

The digital gamma circuit 10 may receive the command signal CMD for adjusting white color coordinates, and may adjust white color coordinates using offset values set with respect to a color standard corresponding to the command signal CMD. For example, at normal times, the digital gamma circuit 10 may support only a 2.2 gamma curve or color coordinates of sRGB without separately adjusting color coordinates.

When receiving, from an application (not illustrated), the command signal CMD instructing the adjustment of white color coordinates to DCI-P3 color coordinates, the digital gamma circuit 10 may adjust the white color coordinates by applying an offset value corresponding to the DCI-P3 color coordinates. For example, when a smartphone user watches a movie, the application may provide the digital gamma circuit 10 of the source driver 100 with the command signal CMD instructing the adjustment of the white color coordinates to the DCI-P3 color coordinates.

When receiving, from the application, the command signal CMD instructing the adjustment of white color coordinates to Adobe RGB color coordinates, the digital gamma circuit 10 may adjust the white color coordinates by applying an offset value corresponding to the Adobe RGB color coordinates. For example, when a smartphone user wants to see a photo or attempts to watch a screen with a vivid color sense, the application may provide the digital gamma circuit 10 of the source driver 100 with the command signal CMD instructing the adjustment of white color coordinates to the Adobe RGB color coordinates.

For example, when the command signal CMD is received, offset values for various color standards may be received from a controller (not illustrated) or an application. For another example, offset values for various color standards may be stored in a memory (not illustrated). Offset values of the memory corresponding to the command signal CMD may be applied to adjust white color coordinates. The memory may be configured inside or outside the source driver 100.

Furthermore, the digital gamma circuit 10 may receive the gray signal GRAY, and may convert the gray signal GRAY into data DATA indicative of a luminance value by using a gamma curve.

In this case, the digital gamma circuit 10 may select values of two X-axis points including the gray signal GRAY between X-axis points. Furthermore, the digital gamma circuit 10 may select values of two Y-axis points adjacent to the gray signal GRAY and corresponding to the values of the two X-axis points.

As described above, the digital gamma circuit 10 may calculate a luminance value corresponding to the gray signal GRAY through linear interpolation using the values of the two X-axis points and the values of the two Y-axis points that are selected as described above.

The digital gamma circuit 10 may convert the 12-bit gray signal GRAY into 10-bit data DATA indicative of a luminance value, and may provide the data DATA to the gamma decoder 30.

The gamma voltage generator 20 may generate 1,024 gamma voltages and provide the 1,024 gamma voltages to the gamma decoder 30.

The gamma decoder 30 may receive gamma voltages from the gamma voltage generator 20, may receive data DATA indicative of a luminance value from the digital gamma circuit 10, and may select a gamma voltage corresponding to the data DATA among the gamma voltages. That is, the gamma decoder 30 may select a gamma voltage corresponding to brightness of a screen, and may provide the selected gamma voltage to the output buffer 40.

The output buffer 40 may output, to a display panel (not illustrated), a gamma voltage provided by the gamma decoder 30. That is, the output buffer 40 may output, to the display panel, the gamma voltage for a 256 gray image corresponding to the gray signal GRAY having 256 grayscales.

The digital gamma circuit 10 may set a gamma curve for each R, G, or B, and may adjust white color coordinates by adding an offset value, corresponding to a color standard, to a value of at least one Y-axis point corresponding to white, that is, the final Y-axis point, among values of Y-axis points of the gamma curve.

Figure 2:
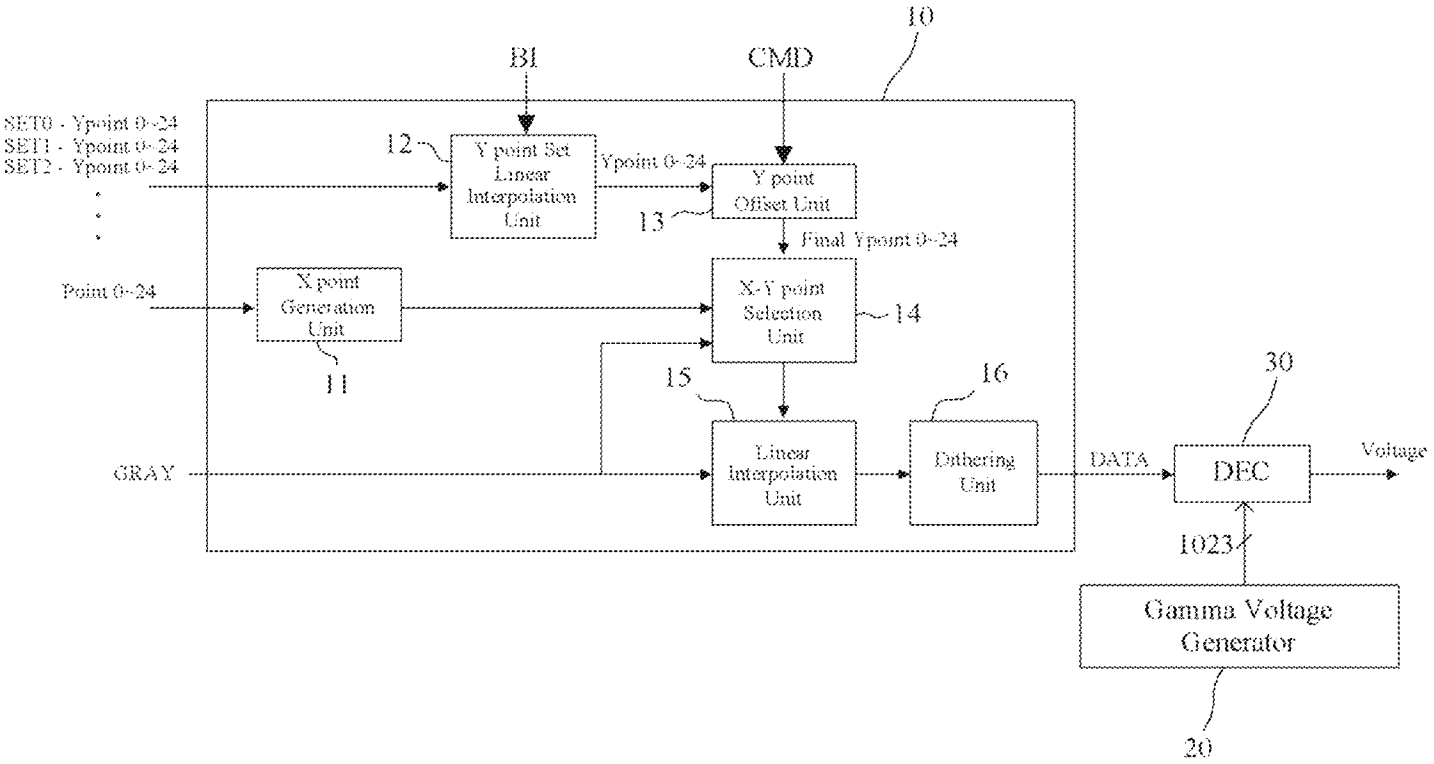
FIG. 2 is a block diagram of a digital gamma circuit in FIG. 1.

FIG. 2 is a block diagram of the digital gamma circuit 10 according to an embodiment.

Referring to FIG. 2, the digital gamma circuit 10 may include a digital gamma algorithm. The digital gamma algorithm may be represented as having a plurality of function blocks. The plurality of function blocks may be represented as including an X point generation unit 11, a Y point set linear interpolation unit 12, a Y point offset unit 13, an X-Y point selection unit 14, a linear interpolation unit 15 and a dithering unit 16.

The digital gamma circuit 10 may be configured to be capable of setting a gamma curve for each R, G, or B through the digital gamma algorithm. For example, the digital gamma circuit 10 may generate a gamma curve by using a maximum of 25 points in each of the X axis and the Y axis.

The digital gamma circuit 10 may additionally receive point values for the X axis, point values for the Y axis, brightness information and offset values in addition to the gray signal GRAY and the command signal CMD described with reference to FIG. 1. The point values for the X axis are indicated as Point 0 to 24. The point values for the Y axis are indicated as SET0-Ypoint 0 to 24, SET1-Ypoint 0 to 24 and SET2-Ypoint 0 to 24. The brightness information is indicated as BI. The point values for the X axis, the point values for the Y axis, the brightness information and the offset values may be understood through descriptions to be given later.

The digital gamma circuit 10 may receive the point values Point 0 to 24 and generate a value of X-axis point of a gamma curve. The value of X-axis point of the gamma curve may be generated by the X point generation unit 11. The X point generation unit 11 may generate values Xpoint0 to Xpoint24 of the X-axis points (refer to FIG. 4) at intervals of a square of 2 in accordance with the point values Point 0 to 24.

For example, when receiving 0 as a value of a point (the point value=Point 0), the X point generation unit 11 may set a value Xpoint0 of the X-axis point0 to 0. Furthermore, when receiving 1 as a value of a point (the point value=Point 1), the X point generation unit 11 may set a value Xpoint1 of the X-axis point1 as $Xpoint0+2^1$. Furthermore, when receiving 2 as a value of a point (the point value=Point 2), the X point generation unit 11 may set a value Xpoint2 of the X-axis point2 as $Xpoint1+2^2$.

In such a manner, the values Xpoint0 to Xpoint24 of the X-axis points may be set at intervals of a square of 2. A construction for setting the values Xpoint0 to Xpoint24 of the X-axis points at intervals of a square of 2 is for calculating luminance by replacing a divider with a shift operation without using the divider upon linear interpolation for calculating corresponding luminance, if the gray signal GRAY indicating a degree of brightness is inputted as a value between values of two X-axis points.

Furthermore, the digital gamma circuit 10 may set values of Y-axis points of a gamma curve corresponding to the values Xpoint0 to Xpoint24 of the X-axis points set at intervals of a square of 2 as described above, based on target brightness.

For example, one set may be set as values Ypoint0 to Ypoint24 of Y-axis points. Such a set may be set in plural depending on target brightness of a panel. For example, a first set SET0 may be set as values of Y-axis points indicative of the highest brightness. A second set SET1 may be set as values of Y-axis points indicative of medium brightness. A third set SET2 may be set as values of Y-axis points indicative of the lowest brightness. For example, the values of Y-axis points of the first set SET0 may be indicated as SET0-Ypoint 0 to 24, the values of Y-axis points of the second set SET1 may be indicated as SET1-Ypoint 0 to 24, and the values of Y-axis points of the third set SET2 may be indicated as SET2-Ypoint 0 to 24.

Furthermore, in order to indicate various types of brightness, the digital gamma circuit 10 may calculate values of Y-axis points between sets through linear interpolation. The linear interpolation for the values of the Y-axis points between the sets may be performed by the Y point set linear interpolation unit 12.

For example, when receiving brightness information BI indicative of target brightness in a panel, the Y point set linear interpolation unit 12 of the digital gamma circuit 10 may select a set corresponding to the brightness information BI, or may calculate the values Ypoint0 to Ypoint24 of Y-axis points through linear interpolation for values of Y-axis points between sets adjacent to brightness corresponding to the brightness information BI. The brightness information BI may be received from an application, and may be received in the form of binary data. For example, when receiving brightness information BI between the first set and the second set, the Y point set linear interpolation unit 12 may calculate the values Ypoint0 to Ypoint24 of the Y-axis points corresponding to the brightness information BI by using the values SET0-Ypoint 0 to 24 of the Y-axis points of the first set and the values SET1-Ypoint 0 to 24 of the Y-axis points of the second set.

Furthermore, the digital gamma circuit 10 may adjust white color coordinates.

For example, the digital gamma circuit 10 may adjust white color coordinates by adding an offset value for each R, G, or B to a value of at least one Y-axis point indicative of white, among the values Ypoint0 to Ypoint24 of the Y-axis points. The white color coordinates may be adjusted by the Y point offset unit 13.

For example, the Y point offset unit 13 of the digital gamma circuit 10 may adjust white color coordinates by adding a different offset value or the same offset value to values of two or more Y-axis points indicative of white.

The Y point offset unit 13 of the digital gamma circuit 10 may set offset values with respect to each of various color standards. For example, the Y point offset unit 13 may set offset values for each R, G, or B with respect to each of various color standards, such as Adobe RGB, sRGB, and DCI-P3.

The digital gamma circuit 10 may receive the command signal CMD for adjusting white color coordinates. The Y point offset unit 13 may adjust white color coordinates using offset values set with respect to a color standard corresponding to the command signal CMD.

For example, when a user attempts to watch a movie, an application may provide the source driver 100 with the command signal CMD instructing the adjustment of white color coordinates to DCI-P3 color coordinates. When receiving, from the application, the command signal CMD instructing the adjustment of the white color coordinates to the DCI-P3 color coordinates, the digital gamma circuit 10 of the source driver 100 may adjust the white color coordinates of a gamma curve by applying an offset value corresponding to the DCI-P3 color coordinates. In this case, a 2.2 gamma curve needs to be maintained although the white color coordinates are adjusted.

Furthermore, when a user wants to see a photo or attempts to watch a screen with a vivid color sense, the application may provide the source driver 100 with the command signal CMD instructing the adjustment of white color coordinates to Adobe RGB color coordinates. When receiving, from the application, the command signal CMD instructing the adjustment of the white color coordinates to the Adobe RGB color coordinates, the digital gamma circuit 10 of the source driver 100 may adjust the white color coordinates by applying an offset value corresponding to the Adobe RGB color coordinates.

An operation of the Y point offset unit 13 adjusting white color coordinates using an offset value corresponding to the command signal CMD is described later with reference to FIG. 3.

The digital gamma circuit 10 of the source driver 100 may be designed to receive offset values for a corresponding color standard when receiving the command signal CMD for adjusting color coordinates. Alternatively, the digital gamma circuit 10 of the source driver 100 may be designed to invoke values of corresponding offsets from a memory in which the offset values for a corresponding color standard are stored, when receiving the command signal CMD for adjusting color coordinates.

Furthermore, the digital gamma circuit 10 may receive, from the application, the gray signal GRAY indicative of a degree of brightness of an image to be displayed on a display panel, and may convert the gray signal GRAY into data DATA indicative of a luminance value through a set gamma curve.

For example, the digital gamma circuit 10 may find where the received gray signal GRAY is located between X-axis points, and may select values of two X-axis points necessary for linear interpolation. Furthermore, the digital gamma circuit 10 may select values of two Y-axis points corresponding to the values of the two X-axis points.

The values of the two X-axis points and the values of the two Y-axis points may be selected by the X-Y point selection unit 14. That is, the X-Y point selection unit 14 may select the values of the two X-axis points adjacent to the gray signal GRAY, and may select the values of the two Y-axis points corresponding to the values of the two X-axis points.

Furthermore, the digital gamma circuit 10 may calculate a luminance value corresponding to the gray signal GRAY by using the values of the two X-axis points and the values of the two Y-axis points.

The linear interpolation unit 15 may calculate the luminance value corresponding to the gray signal GRAY using the values of the two X-axis points and the values of the two Y-axis points. It may be understood that the linear interpolation unit 15 performs linear interpolation on the values of the two X-axis points and linear interpolation on the values of the two Y-axis points in response to the gray signal GRAY. The linear interpolation unit 15 may output the gray signal GRAY having a luminance value calculated by the pieces of linear interpolation.

The digital gamma circuit 10 may convert the 12-bit gray signal GRAY, outputted by the linear interpolation unit 15, into 10-bit data DATA indicative of the luminance value by using dithering. The dithering may be performed by the dithering unit 16. The dithering may be defined as an image processing scheme used in a process of reducing the number of colors of an image. Such dithering enables a high-definition image to be displayed by generating a pattern using a combination of similar colors in order to represent a shadow or a color by using a limited number of colors.

The dithering may be classified into temporal dithering and spatial dithering. The temporal dithering enables the representation of a large number of colors by combining frame sequences continuous to time by using an average of the times. The spatial dithering enables the expansion of representable grayscales by using an average of spaces.

It is possible to expect an effect in that a decimal point for lower 2 bits can be represented when 12 bits corresponding to a value of a Y-axis point are provided to the gamma decoder 30 as 10-bit data through such a dithering function.

For example, when a voltage for V<0> and a voltage for V<1> selected by the gamma decoder 30 are 6 V and 5 V, respectively, a voltage selected by the gamma decoder 30 is 6 V or 5 V, but a voltage effect of 5.25 V, 5.5 V, or 5.75 V can be exhibited due to the dithering effect. Accordingly, brightness can be finely adjusted.

Figure 3:
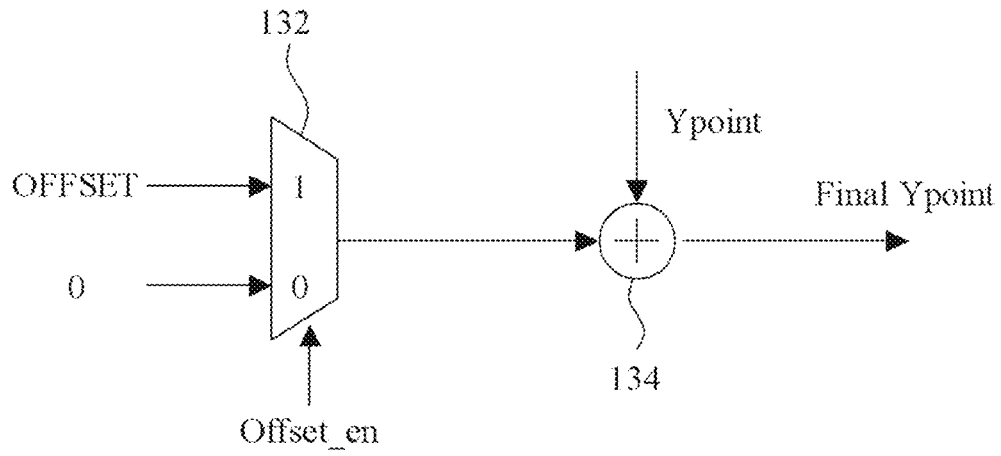
FIG. 3 is a circuit diagram for describing the adjustment of white color coordinates of the digital gamma circuit.

FIG. 3 is a circuit diagram for describing the adjustment of white color coordinates by the Y point offset unit 13 of the digital gamma circuit 10.

Referring to FIGS. 1 to 3, it may be understood that a value of an X-axis point and a value of a Y-axis point finally set among values of set X-axis points and values of set Y-axis points correspond to white color coordinates. In this case, it may be understood that the finally set value of the X-axis point and the finally set value of the Y-axis point are the greatest value of the X-axis point and the greatest value of the Y-axis point, respectively.

In order to adjust white color coordinates, a value of a Y-axis point corresponding to the white color coordinates needs to be adjusted. Offset values for adjusting respective R, G, and B are necessary because white is made by a combination of R, G, and B.

Various panel companies may each want to use a different number of X-axis points. Accordingly, an offset designation range needs to be freely applied.

Offset values for the R, G, and B may be set with respect to each of various color standards.

The digital gamma circuit 10 may select an offset value OFFSET in response to an offset enable signal Offset_en provided in response to the command signal CMD, and may adjust white color coordinates by adding the offset value to a value Ypoint of a Y-axis point indicative of white.

To this end, as in FIG. 3, the Y point offset unit 13 of the digital gamma circuit 10 may be configured to include a multiplexer 132 and an adder 134. In this case, the multiplexer 132 is configured to select and provide one of the offset value OFFSET and 0 in response to the offset enable signal Offset_en. The adder 134 is configured to output white color coordinates Final Ypoint obtained by adding the offset value OFFSET or 0, provided by the multiplexer 132, to a value Ypoint of the Y-axis point indicative of white.

For example, when receiving the command signal CMD corresponding to sRGB color coordinates, the digital gamma circuit 10 may support only a 2.2 gamma curve or the sRGB color coordinates without adjusting color coordinates.

When receiving the command signal CMD corresponding to DCI-P3 color coordinates, the digital gamma circuit 10 may select the offset value OFFSET corresponding to the DCI-P3 color coordinates, and may adjust a value Final Ypoint of the final Y-axis point by adding the offset value OFFSET to a value Ypoint of a Y-axis point corresponding to white.

When receiving the command signal CMD corresponding to Adobe RGB color coordinates, the digital gamma circuit 10 may select the offset value OFFSET corresponding to the Adobe RGB color coordinates, and may adjust the value Final Ypoint of the final Y-axis point by adding the offset value OFFSET to a value Ypoint of a Y-axis point corresponding to white.

In this case, the digital gamma circuit 10 may adjust the value Final Ypoint of the final Y-axis point by applying different offset values to values of Y-axis points indicative of white, or may adjust the value Final Ypoint of the final Y-axis point by applying, when receiving information indicating which of the Y-axis points corresponds to white, the same offset value to all Y-axis points after the Y-axis point corresponding to white.

Furthermore, when a value of the final X-axis point is smaller than a maximum value of the gray signal GRAY or the gray signal GRAY having a value between the value of the final X-axis point and the maximum value of the gray signal GRAY is received, the digital gamma circuit 10 may set the value Final Ypoint of the final Y-axis point corresponding to the value of the final X-axis point so that the value of the final Y-axis point is maintained.

Figure 4:
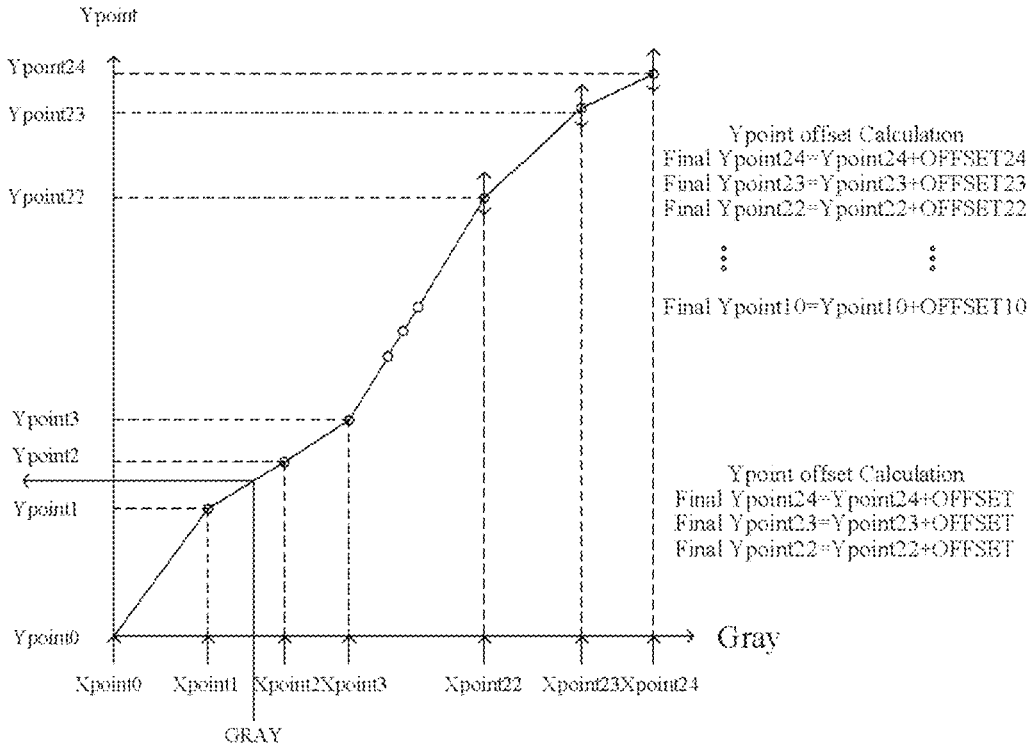
FIG. 4 is a graph illustrating a gamma curve set by the digital gamma circuit.

FIG. 4 is a graph illustrating a gamma curve set by the digital gamma circuit according to an embodiment.

Referring to FIG. 4, an X axis indicates the inputted gray signal GRAY indicative of screen brightness, a Y axis indicates outputted luminance, and a slope of the gamma curve indicates gamma values.

The digital gamma circuit 10 may set values of X-axis points at intervals of a square of 2. For example, the value Xpoint0 of the X-axis Xpoint0 may be set to 0, the value Xpoint1 of an X-axis point1 may be set as $Xpoint0+2^1$, and the value Xpoint2 of an X-axis point2 may be set as $Xpoint1+2^2$. In this way, the values of the X-axis points may be set at intervals of a square of 2.

The digital gamma circuit 10 may freely set values of Y-axis points of a gamma curve, corresponding to values of X-axis points set at intervals of a square of 2, depending on target brightness. For example, values of Y-axis points may be set as several sets depending on target brightness of a panel.

The digital gamma circuit 10 may calculate a luminance value corresponding to the gray signal GRAY through linear interpolation.

For example, when the gray signal GRAY having a value between the values Xpoint1 and Xpoint2 of the X-axis points is inputted, the digital gamma circuit 10 may calculate a luminance value corresponding to the gray signal GRAY by using the values Xpoint1 and Xpoint2 of the X-axis points and the values Ypoint1 and Ypoint2 of Y-axis points corresponding to the values Xpoint1 and Xpoint2 of the X-axis points.

The digital gamma circuit 10 may adjust white color coordinates. For example, the digital gamma circuit 10 may adjust values of the final Y-axis points by adding an offset value for each R, G, or B to a value of at least one Y-axis point indicative of white among values of Y-axis points.

For example, when a value of an X-axis point indicative of white is Xpoint22, the digital gamma circuit 10 may adjust white color coordinates by applying different offset values offset22, offset23, and offset24 or the same offset value to the values Ypoint22, Ypoint23, and Ypoint24 of Y-axis points corresponding to the values Xpoint22, Xpoint23, and Xpoint24 of the X-axis points.

The digital gamma circuit according to an embodiment can adjust white color coordinates by adding an offset value to a value of at least one Y-axis point indicative of white among values of Y-axis points of a gamma curve.

Furthermore, the digital gamma circuit can reduce a chip area by setting values of X-axis points of a gamma curve at intervals of a square of 2.

What is claimed is:

1. A digital gamma circuit comprising:

a digital gamma algorithm for setting a gamma curve for each R, G, or B, wherein through the digital gamma algorithm, values of X-axis points of the gamma curve are set, values of Y-axis points of the gamma curve corresponding to the values of the X-axis points are set, and a value of at least one Y-axis point of the gamma curve indicative of white among the values of the Y-axis points is adjusted by adding an offset value thereto, wherein the digital gamma algorithm receives a gray signal, selects values of two X-axis points adjacent to the gray signal and values of two Y-axis points corresponding to the values of the two X-axis points, and calculates a luminance value by using the selected values of the two X-axis points and the selected values of the two Y-axis points.

2. The digital gamma circuit of claim 1, wherein the values of the X-axis points are set at intervals of a square of 2.

3. The digital gamma circuit of claim 1, wherein the digital gamma algorithm adjusts, as another offset value, the values of two or more Y-axis points of the gamma curve indicative of white among the values of the Y-axis points.

4. The digital gamma circuit of claim 1, wherein, when one of the Y-axis points is set to a white point, the digital gamma algorithm adjusts values of Y-axis points after the white point to a same offset value.

5. The digital gamma circuit of claim 1, wherein the offset values are differently set with respect to each of various color standards.

6. The digital gamma circuit of claim 5, wherein when receiving a command signal for adjusting white color coordinates, the digital gamma algorithm adjusts the value of the at least one Y-axis point corresponding to a white, based on an offset value set for a color standard corresponding to the command signal.

7. The digital gamma circuit of claim 1, wherein the digital gamma algorithm converts the 12-bit gray signal into 10-bit data.

8. The digital gamma circuit of claim 1, wherein:

the values of the Y-axis points are set as several sets depending on target brightness of a panel, and when receiving brightness information from an application, the digital gamma algorithm selects a set corresponding to the brightness information or calculates values of Y-axis points between the sets through linear interpolation.

9. The digital gamma circuit of claim 1, wherein:

the digital gamma circuit comprises an X point generation unit, a Y point set linear interpolation unit, a Y point offset unit, an X-Y point selection unit, a linear interpolation unit and a dithering unit for the digital gamma algorithm, the X point generation unit receives the values of the X-axis points and generates the values of the X-axis points of the gamma curve at intervals of a square of 2, the Y point set linear interpolation unit receives brightness information and values of first Y-axis points of a plurality of sets and calculates values of second Y-axis points through linear interpolation for values of first Y-axis points between sets adjacent to the brightness information, the Y point offset unit adjusts a value of the at least one second Y-axis point corresponding to the white, based on an offset value set for a color standard corresponding to in response to an external command signal, the X-Y point selection unit receives an external first gray signal and selects values of two X-axis points adjacent to the first gray signal and values of two second Y-axis points corresponding to the values of the two X-axis points, wherein the values of the two X-axis points are selected among the values of the X-axis points provided by the X point generation unit, and the values of the two second Y-axis points are selected among the values of the Y-axis points provided by the Y point offset unit, the linear interpolation unit receives the first gray signal and outputs a second gray signal having a luminance value calculated using the values of the two X-axis points and the values of the two second Y-axis points selected by the X-Y point selection unit, and the dithering unit converts the second gray signal having a first bit number into data having a second bit number and indicative of the luminance value through dithering and outputs the data.

10. A source driver comprising:

a digital gamma circuit configured to set a gamma curve for each R, G, or B and convert an inputted gray signal into data indicative of a luminance value by using the gamma curve;

a gamma voltage generator configured to generate and provide gamma voltages; and a gamma decoder configured to receive the gamma voltages and the data and select and output a gamma voltage corresponding to the data, wherein the digital gamma circuit sets values of X-axis points of the gamma curve, sets values of Y-axis points of the gamma curve corresponding to the values of the X-axis points, and adjusts a value of at least one Y-axis point of the gamma curve indicative of white among the values of the Y-axis points by adding an offset value thereto, wherein the digital gamma circuit receives a gray signal, selects values of two X-axis points adjacent to the gray signal and values of two Y-axis points corresponding to the values of the two X-axis points, and calculates a luminance value by using the selected values of the two X-axis points and the selected values of the two Y-axis points.

11. The source driver of claim 10, wherein the digital gamma circuit sets the values of the X-axis points at intervals of a square of 2.

12. The source driver of claim 10, wherein the digital gamma circuit adjusts, as another offset value, the values of two or more Y-axis points indicative of white.

13. The source driver of claim 10, wherein, when one of the Y-axis points is set to a white point, the digital gamma circuit adjusts values of Y-axis points after the white point to a same offset value.

14. The source driver of claim 10, wherein the offset values are differently set with respect to each of various color standards.

15. The source driver of claim 14, wherein when receiving a command signal for adjusting white color coordinates, the digital gamma circuit adjusts the value of the at least one Y-axis point corresponding to the white, based on an offset value set for a color standard corresponding to the command signal.

16. The source driver of claim 10, wherein the digital gamma circuit converts the 12-bit gray signal into 10-bit data.

17. The source driver of claim 10, wherein:

the values of the Y-axis points are set as several sets depending on target brightness of a panel, and when receiving brightness information from an application, the digital gamma circuit selects a set corresponding to the brightness information or calculates values of Y-axis points between the sets through linear interpolation.

18. The source driver of claim 10, wherein:

the digital gamma circuit comprises an X point generation unit, a Y point set linear interpolation unit, a Y point offset unit, an X-Y point selection unit, a linear interpolation unit and a dithering unit, the X point generation unit receives the values of the X-axis points and generates the values of the X-axis points of the gamma curve at intervals of a square of 2, the Y point set linear interpolation unit receives brightness information and values of first Y-axis points of a plurality of sets and calculates values of second Y-axis points through linear interpolation for values of first Y-axis points between sets adjacent to the brightness information, the Y point offset unit adjusts a value of at least one second Y-axis point corresponding to the white, based on an offset value set for a color standard in response to an external command signal, the X-Y point selection unit receives an external first gray signal and selects values of two X-axis points adjacent to the first gray signal and values of two second Y-axis points corresponding to the values of the two X-axis points, wherein the values of the two X-axis points are selected among the values of the X-axis points provided by the X point generation unit, and the values of the two second Y-axis points are selected among the values of the Y-axis points provided by the Y point offset unit, the linear interpolation unit receives the first gray signal and outputs a second gray signal having a luminance value calculated using the values of the two X-axis points and the values of the two second Y-axis points selected by the X-Y point selection unit, and the dithering unit converts the second gray signal having a first bit number into data having a second bit number and indicative of the luminance value through dithering and outputs the data.

* * * * *